US011856667B2

(12) United States Patent
Alava

(10) Patent No.: US 11,856,667 B2
(45) Date of Patent: Dec. 26, 2023

(54) SELF-REGULATING POWER SUPPLY AND METHOD FOR REGULATING AN OUTPUT OF A SELF-REGULATING POWER SUPPLY

(71) Applicant: TEKNOWARE OY, Lahti (FI)

(72) Inventor: Matti Alava, Lahti (FI)

(73) Assignee: TEKNOWARE OY, Lahti (FI)

( * ) Notice: Subject to any disclaimer, the term of this patent is extended or adjusted under 35 U.S.C. 154(b) by 37 days.

(21) Appl. No.: 17/697,449

(22) Filed: Mar. 17, 2022

(65) Prior Publication Data

US 2022/0304124 A1 Sep. 22, 2022

(30) Foreign Application Priority Data

Mar. 19, 2021 (FI) ..... 20215310

(51) Int. Cl.
*H05B 45/345* (2020.01)
*H05B 45/10* (2020.01)

(52) U.S. Cl.
CPC ..... *H05B 45/345* (2020.01); *H05B 45/10* (2020.01)

(58) Field of Classification Search
CPC ..... H01J 65/048; H01J 61/56; H01J 61/28; H01J 5/54; H01J 7/20; H01J 7/22; H01J 9/247; H01J 9/323; H01J 9/34; H01J 9/395; H01J 9/40; H01J 61/523; H01J 61/20; H01J 61/24; H01J 61/35; H01J 61/44; H01J 61/46; H01J 61/72; H01J 65/042;

(Continued)

(56) References Cited

U.S. PATENT DOCUMENTS 9,795,000 B1 * 10/2017 Sooch ..... H05B 47/16
10,111,298 B2 * 10/2018 Mezack ..... H05B 45/37

(Continued)

FOREIGN PATENT DOCUMENTS

CN 204559932 U 8/2015
EP 2785144 A2 10/2014

(Continued)

OTHER PUBLICATIONS

Extended European Search Report for Application No. 22162003.2, dated Jul. 15, 2022, 10 pages.

(Continued)

*Primary Examiner* — Monica C King
(74) *Attorney, Agent, or Firm* — Lippes Mathias LLP

(57) ABSTRACT

A self-regulating power supply (601, 901) for a led light source comprises a drive power input (602, 603) and a lighting output (604, 605, 904, 905), and therebetween a converter (606, 906) for generating a supply voltage and a supply current from drive power. In addition, it comprises voltage regulating means (607, 907), current regulating means (608, 908), and a control unit (609, 909) which controls said voltage and current regulating means (607, 608, 907, 908). The control unit (609, 909) is arranged to change (701, 802) the supply voltage in a controlled manner to detect where an operating voltage range of the led light source lies, and to measure (703, 803, 806) a value of the supply current in the operating voltage range. It deduces (702, 704) a nominal maximum value of the supply current at least partly on the basis of the measurement of the value of the supply current, and sets (705) the deduced nominal maximum value of the supply current as a target value of the supply current.

8 Claims, 4 Drawing Sheets

(58) Field of Classification Search

Figure 1:
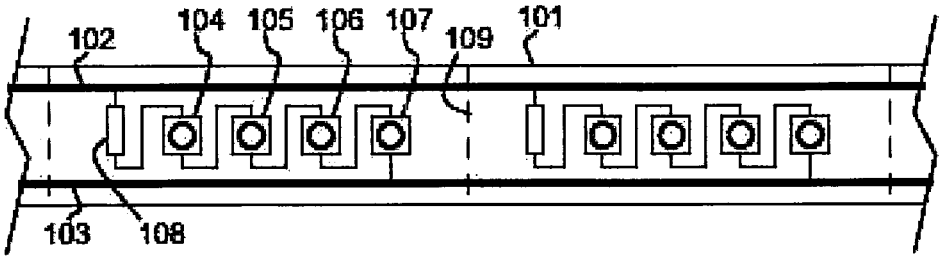

CPC ..... H01J 1/52; H01J 2237/0206; H01J 37/32935; H01J 61/545; H01J 61/547; H05B 45/10; H05B 41/2806; H05B 45/20; H05B 45/00; H05B 45/325; H05B 45/3725; H05B 47/19; H05B 45/395; H05B 47/155; H05B 45/355; H05B 45/37; H05B 45/375; H05B 45/46; H05B 45/56; H05B 41/3924; H05B 45/39; H05B 41/2828; H05B 41/3925; H05B 47/115; H05B 45/38; H05B 45/48; H05B 45/50; H05B 41/3921; H05B 45/22; H05B 45/24; H05B 41/295; H05B 45/385; H05B 47/18; H05B 45/18; H05B 47/105; H05B 41/38; H05B 44/00; H05B 47/14; H05B 45/14; H05B 45/3578; H05B 47/11; H05B 45/44; H05B 45/58; H05B 47/185; H05B 45/28; H05B 47/175; H05B 45/335; H05B 45/347; H05B 45/382; H05B 45/40; H05B 47/17; H05B 47/22; H05B 39/086; H05B 39/088; H05B 41/3927; H05B 45/34; H05B 45/345; H05B 47/125; H05B 47/13; H05B 47/24; H05B 45/30; H05B 45/33; H05B 47/10; H05B 47/16; H05B 47/20; H05B 41/16; H05B 45/12; H05B 45/32; H05B 45/36; H05B 45/54; H05B 47/165; H05B 39/08; H05B 39/00; H05B 39/044; H05B 45/357; H05B 45/3574; H05B 45/59; H05B 45/60; H05B 47/21; H05B 47/26; H05B 47/28; H05B 33/04; H05B 39/045; H05B 41/382; H05B 47/195; F21S 9/02; F21S 4/28; F21S 43/14; F21S 41/645; F21S 45/42; F21S 9/022; F21S 2/00; F21S 4/20; F21S 43/15; F21S 43/195; F21S 8/086; F21S 8/088; F21S 10/06; F21S 41/141; F21S 6/00; F21S 8/081

See application file for complete search history.

(56) References Cited

U.S. PATENT DOCUMENTS 10,609,797 B1 3/2020 Jonsson
10,959,306 B2 * 3/2021 Song ..... H03G 1/0005
11,503,688 B2 * 11/2022 Kumar ..... H05B 45/3575
2006/0103584 A1 * 5/2006 Su ..... H01Q 9/36 343/860
2008/0012777 A1 * 1/2008 Lin ..... H01Q 5/385 343/729
2010/0271802 A1 * 10/2010 Recker ..... H05B 45/12 362/20
2010/0283701 A1 * 11/2010 Cheng ..... H01Q 9/285 343/793
2010/0327766 A1 * 12/2010 Recker ..... H02J 50/40 362/20
2011/0121654 A1 * 5/2011 Recker ..... H05B 45/3725 307/64
2011/0133655 A1 * 6/2011 Recker ..... H05B 47/13 315/159
2012/0026726 A1 * 2/2012 Recker ..... H05B 47/13 362/157
2012/0043889 A1 * 2/2012 Recker ..... H05B 45/385 315/86
2012/0080944 A1 * 4/2012 Recker ..... H05B 47/16 307/25
2013/0201316 A1 * 8/2013 Binder ..... H04L 67/12 701/2
2014/0028200 A1 * 1/2014 Van Wagoner ..... H05B 47/18 315/307
2014/0035484 A1 * 2/2014 Carli ..... H05B 45/10 315/297
2014/0265900 A1 * 9/2014 Sadwick ..... H05B 45/395 315/200 R
2014/0285103 A1 * 9/2014 Acharya ..... H05B 45/395 315/206
2015/0279207 A1 * 10/2015 Breuer ..... H05B 45/12 340/12.5
2015/0334800 A1 * 11/2015 Fawaz ..... H05B 45/385 315/294
2016/0330825 A1 * 11/2016 Recker ..... H05B 47/115
2017/0062940 A1 * 3/2017 Cao ..... H01Q 1/246
2017/0099572 A1 * 4/2017 Breuer ..... H05B 47/175
2017/0180046 A1 * 6/2017 Stout ..... G01C 21/20
2017/0201011 A1 * 7/2017 Khripkov ..... H01Q 1/42
2017/0223807 A1 * 8/2017 Recker ..... H02J 9/02
2017/0231058 A1 * 8/2017 Sadwick ..... H05B 45/18
2017/0324381 A1 * 11/2017 Qian ..... H03F 1/56
2018/0077770 A1 * 3/2018 Sooch ..... H05B 45/20
2018/0077783 A1 * 3/2018 Sooch ..... H05B 45/28
2018/0220506 A1 * 8/2018 Sadwick ..... H05B 47/18
2018/0279429 A1 * 9/2018 Sadwick ..... H05B 45/3725
2018/0375576 A1 * 12/2018 Stout ..... G08B 7/066
2019/0020110 A1 * 1/2019 Paulotto ..... H01Q 5/20
2019/0021154 A1 * 1/2019 Sadwick ..... H05B 45/34
2019/0027822 A1 * 1/2019 Ayala Vazquez ..... H01Q 1/42
2019/0035569 A1 * 1/2019 Sadwick ..... H05B 45/20
2019/0089400 A1 * 3/2019 Zihir ..... H03F 3/45475
2019/0098725 A1 * 3/2019 Sadwick ..... F21S 2/00
2019/0115664 A1 * 4/2019 Veihl ..... H01Q 5/50
2019/0132921 A1 * 5/2019 Rumer ..... H05B 45/375
2019/0215927 A1 * 7/2019 Sooch ..... H05B 47/16
2019/0297784 A1 * 10/2019 Hegde ..... A01G 9/24
2019/0320515 A1 * 10/2019 Sadwick ..... H05B 45/00
2020/0205259 A1 * 6/2020 Hagelaar ..... H05B 45/14
2020/0274242 A1 * 8/2020 Wang ..... H01Q 9/0442
2020/0287277 A1 * 9/2020 Wang ..... H01Q 9/27
2021/0259077 A1 * 8/2021 Squillace ..... H05B 45/46
2022/0104321 A1 * 3/2022 Sooch ..... H05B 47/16
2022/0201820 A1 * 6/2022 Kumar ..... H05B 45/3577
2022/0210889 A1 * 6/2022 Leitner ..... H05B 45/395
2023/0126814 A1 * 4/2023 Wang ..... H05B 45/20 315/291

FOREIGN PATENT DOCUMENTS

TW 1576006 B 3/2017
WO 2019007844 A1 1/2019

OTHER PUBLICATIONS

Finnish Search Report for Application No. 20215310, dated Nov. 1, 2021, 2 pages.
Finnish Office Action for Application No. 20215310, dated Nov. 1, 2021, 5 pages.

* cited by examiner

SELF-REGULATING POWER SUPPLY AND METHOD FOR REGULATING AN OUTPUT OF A SELF-REGULATING POWER SUPPLY

FIELD OF THE INVENTION

The invention generally relates to power supplies used for supplying led light sources. Specifically, the invention relates to a power supply that can automatically regulate its output so that the supply voltage and current delivered from the output to the led light source are suitable for the quantity of leds being in use at a given time for example in a led strip operating as the light source.

BACKGROUND OF THE INVENTION

Light diodes, i.e. leds, are generally used for illumination. The term "led" generally encompasses all light sources in which the mechanism of light generation is recombination of electrons and holes at a semiconductor interface. One much-used way is to fix the leds onto a long strip that can be cut to a segment of a suitable length for the current need.

FIG. 1 illustrates a segment of a led strip 101. Supply wires 102 and 103 extend in a longitudinal direction of the strip. Between the supply wires, the leds form chains in which there is a constant number of leds connected in series. Each of such chains may additionally have its own ballast resistor limiting the current flowing through that chain. In the led strip of FIG. 1, each of the chains includes four leds exemplified by leds 104, 105, 106 and 107. An example of the ballast resistor is designated by reference number 108. This type of a led chain may also be called a branch. It is possible to cut the led strip according to FIG. 1 from any dashed line 109. The allowed cut-off points are located in the led strip so that a led strip having been cut always includes only full chains, i.e. branches.

Figure 2:
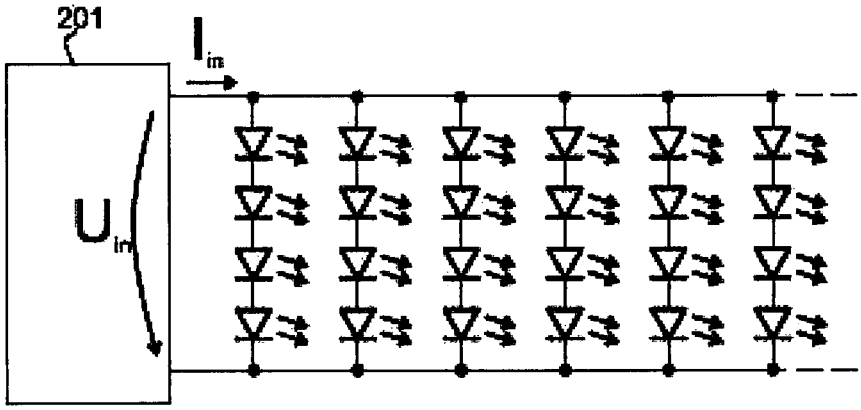
Fig. 2 PRIOR ART

In FIG. 2 a power supply 201 is connected to supply the led strip according to FIG. 1. The symbols of ballast resistors have been omitted for the purpose of simplicity. The power supply 201 maintains a supply voltage $U_{in}$ and a supply current $I_{in}$. Since all of the led branches are similar to each other, the same voltage $U_{in}$ is applied across each one of them, and a current, the magnitude of which is $I_{in}$ divided by the number of parallel branches, flows through each one of them.

Figure 3:
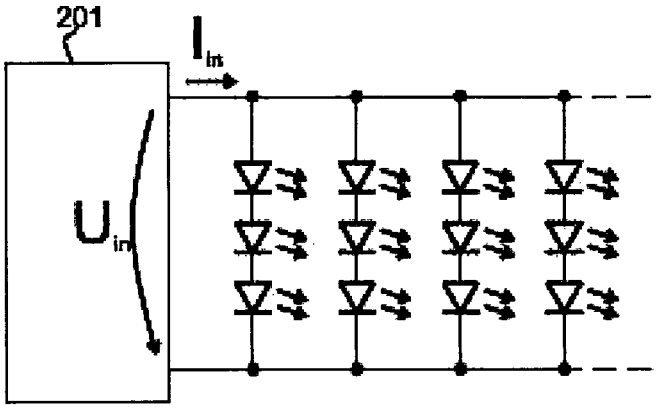
Fig. 3 PRIOR ART

In FIG. 3 the power supply 201 is connected to supply a led strip in which the length of each branch is three leds connected in series. A segment of a different length may also be cut from the led strip, i.e. there may be a different number of branches to be supplied by the power supply than in FIG. 2. It is clear that if an individual led is to shine equally brightly in both cases, the supply voltage $U_{in}$ and the supply current $I_{in}$ must be of a different quantity in FIG. 3 as opposed to FIG. 2.

In principle it is possible to manufacture all led strips in such a way that the leds shine at full brightness always at a specific standardized supply voltage, e.g. 12 V or 24 V, regardless of the length of the led strip. This is done by selecting the number and threshold voltage of the leds of the led branches as well as the resistance of the ballast resistors in a suitable way. However, it is typical of the leds that their tuning accurately to a desired brightness is easier by regulating current than voltage. In addition, a power loss occurring at the ballast resistors generates unnecessary waste heat. Often it is preferred to allow the output voltage of the power supply to acquire relatively freely the value that corresponds to the sum of the threshold voltages of the leds connected in series (and of the voltage drop occurring at the possible ballast resistor), and adjust the brightness of the leds by only regulating the current generated by the power supply.

However, this is a problematic approach in the case of a led strip, as it would require providing the power supply with information about the number of the led branches in the led strip segment to be supplied in each case, i.e. about the length to which the led strip has been cut. On the basis of this information, the power supply could select the value of the generated supply current as a desired current of one led branch multiplied by the length of the strip (i.e. by the number of the branches).

For the user it would be significantly simpler if the power supply could automatically adapt the voltage and current generated in each case to the features of that led strip which it has been connected to supply.

SUMMARY OF THE INVENTION

An object of the present invention is to disclose a self-regulating power supply and a method for regulating an output thereof in such a way that the power supply can automatically adapt the voltage and current generated in each case to the features of that led strip which it has been connected to supply. The features of the led strip thus refer specifically to the number of the leds that are connected in series in the branches contained therein and to the number of such branches that are connected in parallel.

The objects of the invention are achieved by constructing and programming the power supply in such a way that it can find an operating voltage range of a led light source connected thereto, measure a current taken by the led light source in this operating voltage range, and use these measurements in order to set a target value for supply current.

According to a first aspect of the invention, a self-regulating power supply for a led light source is disclosed herein. The power supply comprises a drive power input for receiving drive power, a lighting output for providing supply voltage and supply current to a led light source connected to the lighting output, and between the drive power input and the lighting output, a converter for generating said supply voltage and supply current from said drive power. The power supply also comprises voltage regulating means for regulating a value of said supply voltage, current regulating means for regulating a value of said supply current, and a control unit which is arranged to control said voltage and current regulating means. The control unit is arranged to change the supply voltage in a controlled manner to detect where an operating voltage range of the led light source lies, and to measure the value of the supply current in the operating voltage range. The control unit is also arranged to deduce a nominal maximum value of the supply current at least partly on the basis of said measurement of the value of the supply current made in the operating voltage range, and to set the deduced nominal maximum value of the supply current as a first target value of the supply current.

According to one embodiment, the control unit is arranged to perform the steps as listed above in response to switching on. This provides the advantage that the power supply can always adapt to the present load, even if the load would have changed while the power supply has been switched off.

According to one embodiment, the power supply comprises a control input for receiving control commands, and the control unit is arranged to change a value of the supply voltage and/or the supply current to be supplied to said lighting output in response to a control command received via the control input. This provides the advantage that the power supply is caused to operate in an optimal way in the full regulating range regardless of the length of the led strip to which it is connected.

According to one embodiment, the control unit is arranged to change a value of the supply current to be supplied to the lighting output between said first target value and values smaller than it in response to dimming commands received via the control input. This provides the advantage that the power supply is caused to operate in an optimal way in the full dimming range regardless of the length of the led strip to which it is connected.

According to one embodiment, said lighting output is a first lighting output for providing a first supply voltage and a first supply current to a first led light source connected thereto. The power supply may additionally comprise a second lighting output for providing a second supply voltage and a second supply current to a second led light source connected thereto. In this case, the control unit may be arranged to perform the steps as listed above for both of the lighting outputs. This provides the advantage that the power supply can optimally drive at least two different led light sources.

According to a second aspect of the invention, a method for regulating an output of a self-regulating power supply is disclosed herein. In the method a supply voltage and a supply current are generated for a led light source. Said supply voltage is changed in a controlled manner to detect where an operating voltage range of said led light source lies, and a value of said supply current is measured in said operating voltage range. In addition, in the method a nominal maximum value of said supply current is deduced at least partly on the basis of said measurement of the value of the supply current made in the operating voltage range, and the deduced nominal maximum value of the supply current is set as a first target value of the supply current.

According to one embodiment, said first target value is used to cause said led light source to shine at a full brightness. This provides the advantage that to achieve the right brightness, it is not necessary to separately program the power supply for each different load.

According to one embodiment, after setting said first target value, dimming commands are received, and a value of said supply current is changed between said first target value and values smaller than it in response to the dimming commands received via a control input. This provides the advantage that the power supply is caused to operate in an optimal way in the full dimming range regardless of the length of the led strip to which it is connected.

LIST OF THE FIGURES

Figure 4:
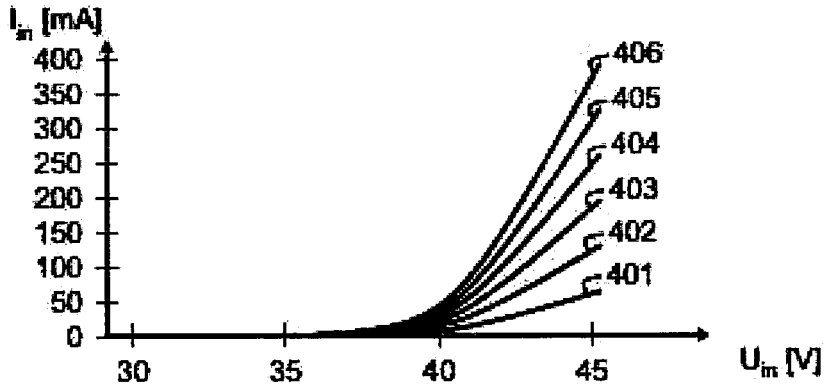
Figure 5:
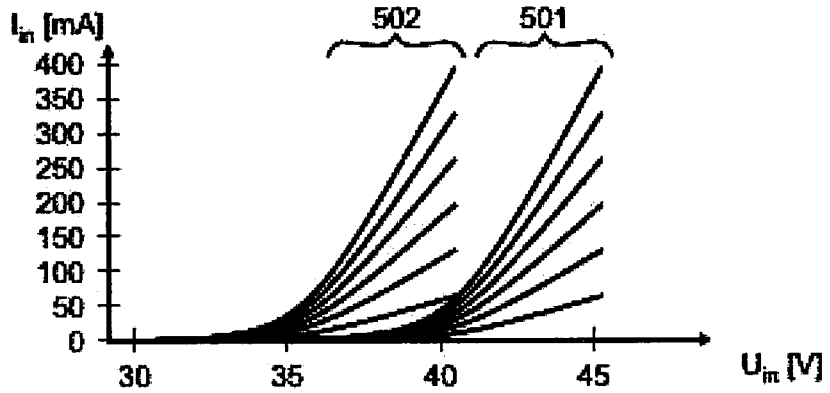
Figure 6:
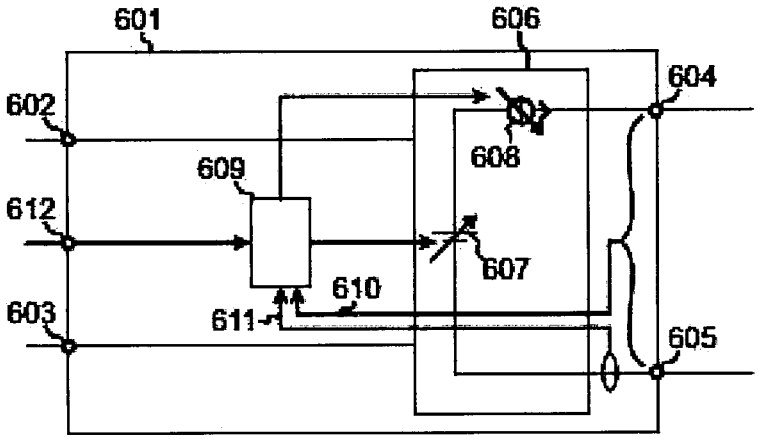
Figure 7:
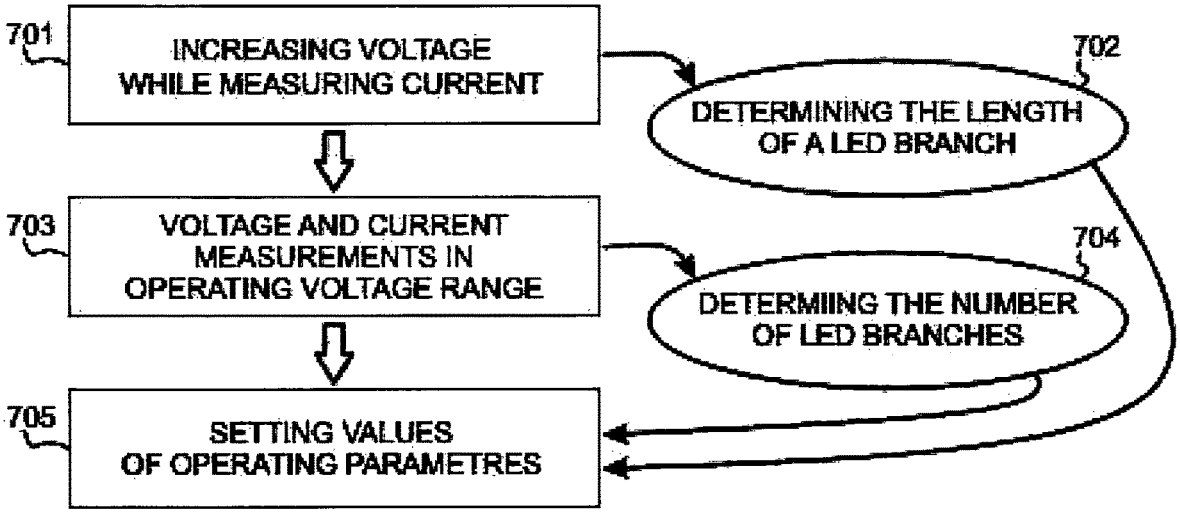
Figure 8:
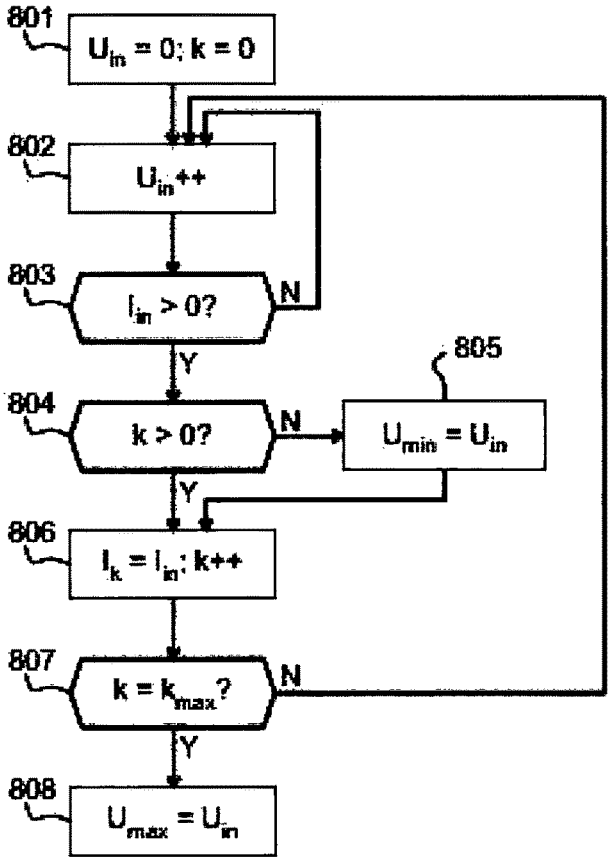
Figure 9:
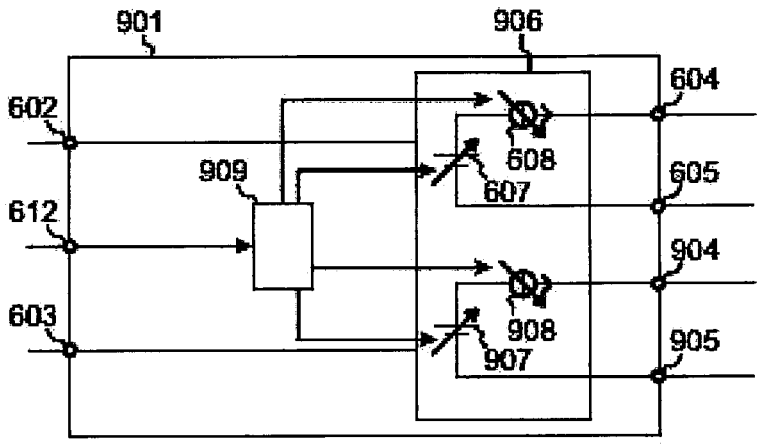

FIG. 1 illustrates a segment of a led strip according to the prior art,

FIG. 2 illustrates a power supply according to the prior art to which a led strip having certain features is connected, FIG. 3 illustrates the same power supply to which a led strip having certain other features is connected, FIG. 4 illustrates some characteristic curves of led strips, FIG. 5 illustrates some other characteristic curves of led strips, FIG. 6 illustrates one self-regulating power supply, FIG. 7 illustrates one method for regulating an output of a power supply, FIG. 8 illustrates one sequence of execution of the method steps, and FIG. 9 illustrates one self-regulating power supply.

DETAILED DESCRIPTION OF THE INVENTION

Possibilities for implementing a self-regulating power supply were studied by making voltage-current-measurements on led networks configured to resemble different types of led strips. FIG. 4 illustrates curves obtained as a result of one such measurement.

There were six different led networks under measurement. The basic part of each led network was a led branch in which there were 15 leds and a common ballast resistor connected in series. The networks differed from each other in the number of such led branches connected in parallel therein. In FIG. 4, curve 401 illustrates a measurement in a led network having only one led branch. The led network of curve 402 had two, the led network of curve 403 three, the led network of curve 404 four, the led network of curve 405 five, and the led network of curve 406 six similar led branches in parallel.

In the measurement, each led network was connected in turn to a power supply, whereby a supply voltage generated by the power supply could be regulated and a supply current generated by the power supply could be measured. In FIG. 4, the horizontal axis represents a supply voltage generated by the power supply in volts and the vertical axis represents a supply current in milliamperes. The supply voltage was at first set to zero and increased therefrom while at the same time a value of the supply current was being measured. As illustrated by curves 401-406, the supply current remained at zero until a value of the supply voltage was approximately 36 V. This was expectable because a value of the threshold voltage of the leds used in the led networks under measurement was approximately 2.4 V, i.e. at values of forward voltage smaller than this these leds do not conduct current. The threshold voltage of the whole led branch containing 15 leds in series is thus 15×2.4 V=36 V.

A maximum value of recommended current as specified by the manufacturer of the leds in question is 65 mA. A value of the supply voltage was increased from 36 V as much that the current flowing in an individual branch of the led network under measurement reached this value. The led branches were similar to each other and due to the parallel connection, the same voltage was applied across them. Thus, from the curves obtained from the measurement it is clearly seen how voltage-current curves 402-406 of the led networks with two or more branches are scaled versions of curve 401 of the led network with one branch. The scaling factor is in each case the number of the led branches, i.e., for example, curve 403 illustrating the measurement for the led network with three branches is in height a three-fold version of measurement curve 401 for one led branch.

In FIG. 5, two sets of curves are drawn in the same coordinate system. A set of curves on the right, specifically distinguishable in area 501, is the same as in FIG. 4. A set of curves on the left, specifically distinguishable in area 502, represents a measurement with six led networks that were otherwise similar to those above, but in each of the led networks each led branch only contained 13 leds connected in series. From the figure it is seen that due to this change, the set of curves just shifts to the left in the coordinate system by a threshold voltage of two leds (2×2.4 V=4.8 V) while otherwise remaining the same.

From FIGS. 4 and 5 it is also seen that the width of the operating voltage range of the led networks under measurement was always the same slightly less than 10 V (36-45.5 V when there were 15 leds in a branch, 31.5-41 V when there were 13 leds in a branch), regardless of the number of the led branches connected in parallel or the number of the leds connected in series in each of the branches. The measurements disclosed herein are part of a wider series of measurements in which a total of 14 led networks consisting of branches of various lengths were measured, with 1-6 such led branches connected in parallel in each of the networks. The series of measurements confirmed the findings according to which the position of the voltage-current curve on the voltage axis in practice only depends on the number of the leds in an individual led branch, and its height in a vertical direction only depends on the number of the led branches connected in parallel.

From these findings we can make the important conclusion that it is possible for a self-regulating power supply to recognize the features of a led strip connected thereto by making certain measurements relating to a change of the supply voltage.

FIG. 6 schematically illustrates one self-regulating power supply 601 for a led light source. The power supply comprises a drive power input formed by two terminals 602 and 603 for receiving drive power, and a lighting output similarly formed by two terminals 604 and 605, which lighting output may be used for providing supply voltage and supply current to a led light source connected to the lighting output. The drive power input may be for example an input interface via which the power supply 601 is connectable to an electricity network that may be for example an alternating voltage network of a building or an outdoor area, a direct voltage network of a vehicle or other such network for delivering electricity to devices. The drive power input does not have to be an external input interface, but it may be (or it may include as a part) an interface for an internal power supply such as a primary or secondary battery.

The power supply 601 comprises, between the drive power input and the lighting output, a converter 606 by which the power supply may generate the above-mentioned supply voltage and supply current from the drive power which it receives via the drive power input. An internal implementation of the converter 606 is not relevant for the purpose of this disclosure, as long as the voltage and current generated by it are regulatable. This is illustrated in FIG. 6 by regulatable voltage source symbol 607 and regulatable current source symbol 608, which are shown as part of the converter 606. The functions represented by the regulatable voltage source 607 and the regulatable current source 608 may be generally called voltage regulating means and current regulating means by which it is possible to regulate a value of the supply voltage and current delivered from the power supply 606 to the led light source. The converter 606 may contain for example one or more rectifiers, transformers, DC/DC converters, filters and/or other electrical structural components known per se.

The power supply 601 further comprises a control unit 609 which is arranged to control the voltage regulating means 607 and the current regulating means 608 of the power supply. The control unit 609 may be or may include for example some programmable circuit such as a microprocessor or a microcontroller as well as memory, I/O interface and other functions which enable the functions to be described below. A detailed structure or implementation of the control unit 609 is not relevant for the purpose of the present subject-matter. In FIG. 6, the control unit 609 is provided with a possibility to measure a magnitude of the supply voltage and the supply current which the power supply provides to the lighting output. These measurements are schematically illustrated by reference numbers 610 and 611.

FIG. 7 schematically illustrates some functions that the control unit 609 is arranged to perform. Block 701 is an example of how the control unit 609 is arranged to change the supply voltage delivered to the led light source in a controlled manner to detect where an operating voltage range of the led light source lies. In this text, the operating voltage range refers to a voltage range in which the led light source generates light. A lower limit of the operating voltage range is a voltage at which the leds of the led light source just begin to conduct current, whereby also the recombination of electrons and holes occurring at the semiconductor interface contained therein begins to generate an observable amount of light. An upper limit of the operating voltage range is a voltage at which the current flowing through the leds reaches a maximum value specified for it, which may be for example the highest current value specified by manufacturers of the leds which the led withstands without damage or overheating in that operating environment for which it has been intended.

The above-mentioned detecting where an operating voltage range of the led light source lies does not necessarily require determining the whole operating voltage range. Especially finding an upper limit of the operating voltage range only by increasing the supply voltage and measuring the value of the supply current may be difficult or impossible, as typically at this stage there is not yet knowledge of how many led branches are connected in parallel in the led light source, i.e. in how many parts the supply current generated by the power supply is split as it flows through the led light source. Said detecting where an operating voltage range lies may mean, for example, only detecting a lower limit thereof. In other words, the control unit would be arranged to detect the voltage value at which, or in the immediate vicinity of which, the operating voltage range of the led light source begins. With reference to FIGS. 4 and 5 this would mean finding the voltage at which the current shown by the voltage-current curve begins to significantly rise above zero.

According to deduction block 702 as shown in FIG. 7, the operations performed in block 701 may lead to deducing what is the length of an individual led branch in the led light source. As stated above in connection with FIGS. 4 and 5, a lower limit of the operating voltage range is substantially the same as the sum of the threshold voltages of the leds connected in series. If the threshold voltage of an individual led is known, the length of an individual led branch is obtained from the lower limit of the operating voltage range by simple division.

According to block 703, the control unit is arranged to measure the value of the supply current in the operating voltage range. This may mean determining how steeply the value of the supply current increases when the supply voltage is increased above the lower limit of the operating voltage range. According to FIGS. 4 and 5, the more led branches are connected in parallel in the led light source, the steeper the supply current increases in the operating voltage range.

According to deduction block 704, the measurement made in block 703 may lead to deducing the number of the led branches connected in parallel in the led light source. From this, it is possible to derive a nominal maximum value of the supply current, i.e. that total amount of current to be supplied to the led light source which, when evenly split in the parallel led branches, generates in each of the led branches a current equal to a maximum current of an individual led. The control unit is arranged to deduce a nominal maximum value of the supply current at least partly on the basis of the information provided by the measurement of the value of the supply current made in the operating voltage range. In practice, this may mean for example increasing the supply voltage by a specific constant quantity from the lower limit of the operating voltage range and measuring how high the supply current increased and/or what was the highest value of a derivative of the supply current curve in this interval.

In block 705, the power supply sets a value for one or more operating parameters thereof on the basis of the information provided by the previous steps. The control unit may be arranged to set the deduced nominal maximum value of the supply current as a target value indicating a value of the supply current at which the leds of the led light source shine at a full brightness. This target value may herein be called a first target value.

FIG. 8 illustrates one way in which the operation according to blocks 701 and 703 of FIG. 7 may be implemented in a systematic manner. Step 801 is an initialization in which the values of supply voltage $U_{in}$ and index k are initialized to zero. In steps 802 and 803 the value of supply voltage is increased until a test of step 803 indicates that the supply current has started to rise from zero. If this was the first value of supply voltage at which this observation was made, the value of index k is still zero in a check of step 804. In this case, step 804 is followed by storage of the current value of supply voltage $U_{in}$ as voltage $U_{min}$ that represents a lower limit of the operating voltage range. In step 806 the measured value of supply current that represents the current value of index k is further stored, after which the value of index k is increased. At values of k smaller than a maximum value that has been defined for index k, the method returns from step 807 to step 802. As the method circulates the loop according to steps 802-807, the measured values of supply current $I_0, I_1, I_2, \ldots I_{k-1}$ are stored until the maximum value of index k is reached. The current value of supply voltage $U_{in}$ is stored as maximum value $U_{max}$. Among the stored values, $U_{min}$ is a relatively reliable indicator for the length of an individual led branch. A number that represents the quantity of the led branches connected in parallel is obtained for example by calculation $(I_{k-1}-I_0)/(U_{max}-U_{min})$ or by estimating a first derivative of the current curve by calculating an average from mutual differences of a few latest I values.

The control unit may be arranged to always perform the steps described above in response to switching on. In addition to or instead of this, the control unit may be arranged to perform the steps described above in response to a control command that may be for example a specific on-off sequence of drive power or a command received via a separate control input.

The control unit may be arranged to utilize the data obtained in the above-described way also in a more versatile manner than by merely setting a first target value for the supply current according to which it in future causes the leds of the led light source to shine at a full brightness. The power supply according to the embodiment of FIG. 6 comprises a control input 612 for receiving control commands. The idea in this is that the control unit 609 is arranged to change a value of the supply voltage and/or the supply current to be supplied to the lighting output in response to a control command received via the control input 612. The control input 612 may be for example an interface according to some lighting control standard known per se, such as a 1-10 volt control interface, a DALI interface, a Switch Control interface or the like.

One known way of utilizing control commands is controlled dimming of lights. The control unit 609 may be arranged to change a value of the supply current to be supplied to the lighting output between the above-described first target value (i.e. maximum value) and values smaller than it in response to dimming commands received via the control input 612. If the control unit has stored any supply current values that have been measured in the operating voltage range as part of the steps described above, it may use them, if necessary, as a second, third etc. target value that represent desired dimmed light levels.

FIG. 9 illustrates a self-regulating power supply 901 in which there are two lighting outputs. A lighting output as described above, formed by terminals 604 and 605, is a first lighting output, whereby a supply voltage and current to be supplied to a first led light source connected to the first lighting output may be regulated by means 607 and 608. The power supply 901 comprises a second lighting output formed by terminals 904 and 905 for providing a second supply voltage and a second supply current to a second led light source connected to the second lighting output. A control unit 909 is arranged to perform the operations as described above to determine the features of the led light sources for both of the led light sources. The power supply according to FIG. 9 may be used for example when the led light source is a so-called tunable white strip. Such a strip typically comprises white leds representing two different colour temperatures with their own supply lines, whereby in view of the power supply they are two led light sources distinct from each other. The power supply may change in a controlled manner the colour temperature of the generated white light by regulating the mutual magnitude of the supply currents conducted to the two led light sources. In the power supply there could also be more than two parallel lighting outputs, for each of which the control unit of the power supply may be arranged to perform the same operations.

The invention claimed is:

1. A self-regulating power supply for a led light source, the power supply comprising:

a drive power input for receiving drive power, a lighting output for providing supply voltage and supply current to a led light source connected to the lighting output, between said drive power input and lighting output, a converter for generating said supply voltage and supply current from said drive power, voltage regulating means for regulating a value of said supply voltage, current regulating means for regulating a value of said supply current, and a control unit which is arranged to control said voltage and current regulating means, wherein said control unit is arranged to:

a) change said supply voltage in a controlled manner to detect where an operating voltage range of the led light source lies, b) measure the value of said supply current in said operating voltage range, c) deduce a nominal maximum value of said supply current at least partly on the basis of said measurement of the value of the supply current made in the operating voltage range, and d) set the deduced nominal maximum value of the supply current as a first target value of the supply current.

2. The power supply according to claim 1, wherein said control unit is arranged to perform steps a)-d) in response to switching on.

3. The power supply according to claim 1, wherein:

the power supply comprises a control input for receiving control commands, and said control unit is arranged to change a value of the supply voltage and/or the supply current to be supplied to said lighting output in response to a control command received via the control input.

4. The power supply according to claim 3, wherein:

said control unit is arranged to change a value of the supply current to be supplied to said lighting output between said first target value and values smaller than it in response to dimming commands received via the control input.

5. The power supply according to claim 1, wherein:

said lighting output is a first lighting output for providing a first supply voltage and a first supply current to a first led light source connected thereto, the power supply comprises a second lighting output for providing a second supply voltage and a second supply current to a second led light source connected thereto, said control unit is arranged to perform steps a)-d) for both of the lighting outputs.

6. A method for regulating an output of a self-regulating power supply, in which method a supply voltage and a supply current are generated for a led light source, the method comprising:

changing said supply voltage in a controlled manner to detect where an operating voltage range of said led light source lies, measuring a value of said supply current in said operating voltage range, deducing a nominal maximum value of said supply current at least partly on the basis of said measurement of the value of the supply current made in the operating voltage range, and setting the deduced nominal maximum value of the supply current as a first target value of the supply current.

7. The method according to claim 6, wherein said first target value is used to cause said led light source to shine at a full brightness.

8. The method according to claim 6, wherein after setting said first target value, dimming commands are received, and a value of said supply current is changed between said first target value and values smaller than it in response to the dimming commands received via a control input.

* * * * *